United States Patent [19]

Cameron et al.

[11] Patent Number: 5,030,106

[45] Date of Patent: Jul. 9, 1991

[54] BATTERY JUMPER CABLE CLAMP

[76] Inventors: Robert W. Cameron, 5301 Home Rd., Bellingham, Wash. 98226; Richard Q. Opler, 10615 SE. 22nd St., Bellevue, Wash. 98004

[21] Appl. No.: 477,420

[22] Filed: Feb. 8, 1990

[51] Int. Cl.[5] ..... H01R 11/26; H01R 35/00

[52] U.S. Cl. ..... 439/8; 439/592; 439/765

[58] Field of Search ..... 439/754, 755, 756, 757–760, 439/762–771, 761, 772–774, 6, 8, 9, 592; 269/227, 249

[56] References Cited

U.S. PATENT DOCUMENTS

| | | | |
|---|---|---|---|
| 200,101 | 2/1878 | Starkey | 269/227 |
| 2,908,519 | 10/1959 | Holden | 403/122 |
| 3,328,741 | 6/1967 | Brown | 439/8 |
| 4,978,306 | 12/1990 | Robb | 439/8 |

FOREIGN PATENT DOCUMENTS

| | | | |
|---|---|---|---|
| 302012 | 12/1928 | United Kingdom | 439/8 |

*Primary Examiner*—Gary F. Paumen
*Attorney, Agent, or Firm*—Hughes & Multer

[57] ABSTRACT

A clamp for mounting a jumper cable to a terminal of a storage battery. The clamp comprises first and second movably mounted jaws having opposed gripping faces which define a gap for receiving the terminal. At least one of the gripping faces has an electrical conductor portion thereon for establishing electrical contact with the terminal. The first jaw has a gear rack mounted thereto, which is engaged by a pinion gear which is rotatably mounted to the second jaw. A worm wheel is mounted coaxially to the pinion gear, and is engaged by a drive worm. A handwheel is provided for manual rotation of the drive worm. The resulting movement of the first jaw relative to the second jaw adjusts the gap so that the battery terminal can be received and gripped therein. The clamp may have a bore which penetrates into the electrical conductor portion of the jaw for receiving an end of the jumper cable in electrical contact therewith, and a setscrew for securing the end of the jumper cable in the bore. Alternatively, the clamp may be provided with a female connector member which receives a male conductor member on the cable end. The female member has a metal receptacle with a spherical recess, which receives a spherical protuberance of the male member, so that the clamp is free to rotate about connection, thus avoiding bending of the cable. The spherical protuberance is formed of an elastomeric ball having metal contact fingers arranged about the surface thereof.

11 Claims, 5 Drawing Sheets

BATTERY JUMPER CABLE CLAMP

BACKGROUND OF THE INVENTION

1. Field of the Invention

The present invention relates to clamps for electrical cables in general, and, more particularly, to a clamp for connecting a jumper cable to the post of a motor vehicle storage battery.

2. Background Art

Battery jumper cables are frequently used in the emergency starting of motor vehicles having discharged storage batteries. Such storage batteries have charge storage sections which store electrical charges with which to operate starter motors and other electrical equipment. The charge storage section may accidentally become discharged, in the event that some such equipment (such as headlights), is left energized, if there is a ground in the vehicle's electrical system, or if the battery is simply old and/or worn out.

Typical vehicle storage batteries have external terminals for both the positive and negative poles of the charge storage section. The external terminals typically take the form of short, slightly tapered posts made of a suitable metal, most typically lead or lead alloy. When the storage battery is installed in a motor vehicle, the posts of the battery are typically gripped by lead or copper cable clamps on the ends of electrical cables. Normally, one cable electrically connects a selected terminal of the battery to the electrical system of the vehicle, while the other cable electrically connects the other terminal of the battery to the ground provided by the bodywork of the vehicle. Some varieties of storage batteries have terminals which are flush with the case of the battery, and which are bored and tapped to receive a bolt. The bolt serves to fix a flat, doughnut-shaped cable connector against the terminal. As used in this description and the appended claims, the term "terminal" includes all such battery posts and terminals, either with or without the associated clamps or connectors attached thereto.

When a battery becomes discharged and is unable to start the motor vehicle, resort is frequently made to the use of jumper cables. A second vehicle, having a charged storage battery or an operating engine, is brought proximate to the first vehicle, and jumper cables are used to connect the battery of the second vehicle to that of the first vehicle so that the first vehicle can be started. The jumper cables serve to electrically connect corresponding terminals of the batteries of the two vehicles.

Conventional jumper cables typically comprise a pair of electrical cables, each having an alligator clamp on each end thereof. The alligator clamp, which is typically a large, spring-loaded, stamped metal clamp having serrated jaws, serves to grasp the terminal of the battery. These alligator clamps, while they have long been used, exhibit a number of inconveniences and disadvantages. Perhaps the single most serious disadvantage is the inability of such clamps to securely and immovably grasp the battery terminals; even when they are clamped about battery terminals, they are still easily moved and swiveled about. Often, such movement causes another part of the stamped metal alligator clamp to come into contact with the bodywork of the motor vehicle; if that clamp is secured to the positive terminal of the battery, severe sparking results. Not only does this severe sparking represent the potential for discharging the batteries and damaging the vehicles' electrical systems, but it also represents a significant safety hazard, inasmuch as such sparking may ignite hydrogen gases which emanate from the charge storage sections of batteries. Such alligator clamps are also easily knocked or pulled off of the battery terminals, especially when tension is applied to the jumper cables when attempting to connect them to the other battery, which is both inconvenient and frustrating for the operator. Still further, such conventional alligator clamps, despite their serrated jaws, sometimes grip the battery terminal with insufficient force and/or contact area to adequately penetrate the corrosion which is often present on the surface of the terminal, thus failing to establish effective electrical contact with the terminal.

The foregoing failings of conventional alligator clamps on battery jumper cables stem in no small part from their inability to apply an unyielding force to clamp the jaws about the battery terminal; the springs of the clamps are necessarily quite limited in strength so that an operator can overcome them with the strength of his hand, and, no matter how strong, the springs only serve to yieldingly bias the jaws closed about the terminal.

Another problem which is commonly encountered with conventional jumper cables concerns the connection of the clamps to the associated electrical cables. In use, the clamps are pulled and moved back and forth, both in the process of attaching the cables to battery terminals and in winding the cables for storage. Typically, the wire strands of the cable are simply gripped en masse in a crimped connection formed from an extension of the stamped metal alligator clamp. As the clamps work back and forth on the ends of the electrical cables, the individual wire strands fatigue and eventually break and fray. As the strands break, the ability of the electrical cable to carry current from one battery to the other is significantly reduced. Eventually, the clamp may separate completely from the end of the electrical cable, rendering the jumper cable useless.

Accordingly, there exists a need for a clamp for mounting a jumper cable in electrical contact to a terminal of a vehicle storage battery which grips the terminal securely and unyieldingly, so as to establish an effective electrical connection therewith, and so as to prevent the clamp from accidentally moving on, or becoming detached from, the battery terminal. Furthermore, there is a need for such a clamp which eliminates the fraying and breaking of the wire strands of the jumper cable, as well for such a clamp with which to replace conventional clamps on the ends of battery jumper cables which are frayed or broken.

SUMMARY OF THE INVENTION

The present invention has solved the problems cited above, and comprises a clamp for mounting a jumper cable in electrical contact to a terminal of a storage battery, which clamp has first and second movably mounted jaws defining a gap for receiving the terminal. At least one of the jaws has an electrical conducting portion thereon which is adapted for contacting the terminal, and which is electrically connected to the jumper cable. A gear rack is mounted to the first jaw, and is in engagement with a pinion which is rotatably mounted to the second jaw. Manually operable means are provided for rotating the pinion so as to adjust the gap between the jaws by moving the first jaw relative to the second jaw. The means for rotating the pinion may include a worm wheel mounted coaxially to the pinion, a drive worm in engagement with the worm wheel, and a handwheel mounted coaxially to the drive worm for rotating the drive worm.

The jaws may be made of metal, or may be made of reinforced plastic having the electrical conducting portion formed of a metallic insert on the face of a jaw.

In one embodiment, the first jaw comprises a metallic face for gripping the terminal, and a gear rack extending perpendicular from the gripping face. The second jaw has a second metallic face for gripping the terminal, and a channel perpendicular to the second gripping face for slidably receiving the gear rack on the first jaw. The pinion gear is rotatably mounted to the second jaw for engaging the rack on the first jaw, and has the worm wheel mounted coaxially thereto. The drive worm is rotatably mounted to the second jaw in engagement with the worm wheel gear, and has the handwheel mounted coaxially to an extension thereof so that manual rotation of the drive worm draws the gripping face on the first jaw towards the gripping face on the second jaw.

The end of the jumper cable may be mounted in electrical contact with the electrical conducting portion of a jaw by being received in a bore penetrating the electrical conducting portion and being secured therein by a setscrew in a threaded bore which penetrates the first bore at a substantially right angle thereto. Alternatively, the end of the jumper cable may have a connector attached thereto, the connector having a substantially spherical protuberance which is received in pivotable engagement in a substantially spherical recess in the electrical conducting portion of the jaw and secured therein.

Other features of the present invention will become apparent from the following detailed description.

DESCRIPTION OF THE PREFERRED EMBODIMENTS

Figure 1:
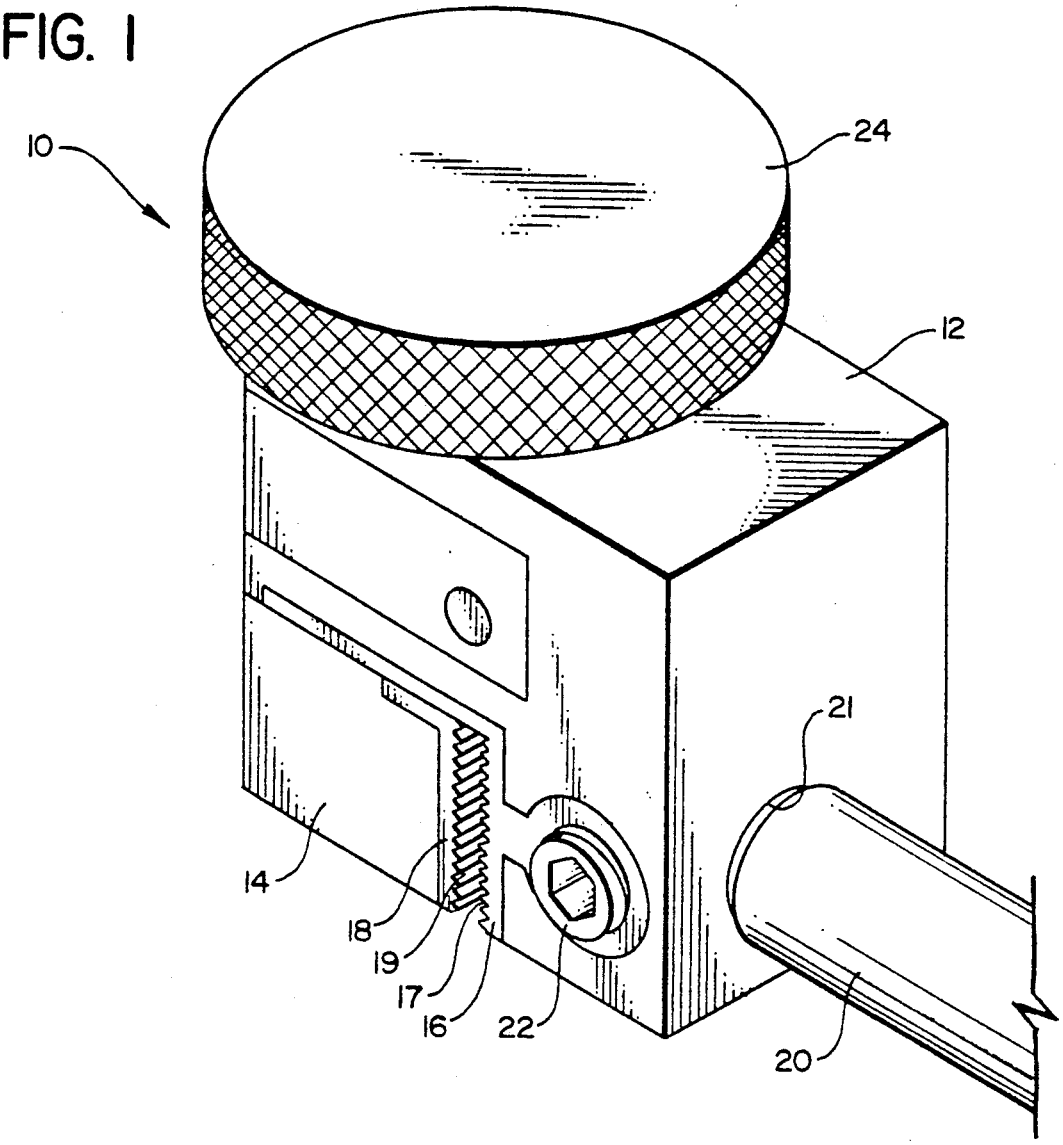
FIG. 1 is a perspective view of a clamp incorporating the present invention, mounted on an end of a jumper cable.

With reference to FIG. 1, there is shown a battery jumper cable clamp 10 incorporating the present invention. Clamp 10 is a fixture which is provided generally with a first jaw 12 and a second jaw 14. First jaw 12 has a first gripping face 16 mounted thereon, while second jaw 14 has a second gripping face 18 mounted thereon. When the first and second jaws are assembled together, first gripping face 16 and second gripping face 18 are arranged facing one another so as to define a gap for receiving the terminal of a storage battery. Gripping faces 16 and 18 are adapted to grip battery terminals, which, as noted above, may or may not include a battery clamp or connector secured about the battery post; gripping faces 16 and 18 are thus provided with teeth or corrugations 17 and 19, respectively, so as to be able to securely grip terminals having a wide variety of shapes and external contours. Such teeth or corrugations also help gripping faces 16 and 18 penetrate any corrosion which may be present on the battery terminals, so as to establish good electrical contact therewith.

In the embodiment of the invention which is illustrated in FIG. 1, both gripping faces 16 and 18 comprise inserts made of a suitable metal having good electrical conductivity, such as, for example, copper, aluminum, or steel. It is important that at least one of the gripping faces be constructed of such conducting material, so as to be able to establish electrical contact with the battery terminal. The remaining portions of the jaws 12 and 14 of clamp 10 shown in FIG. 1 are constructed of reinforced or injected molded plastic, which is an insulating material. This construction has the advantage of relatively low cost (as compared with all-metal construction), and the insulating qualities of the plastic material further reduce the chances of accidentially grounding a terminal of a battery when installing clamp 10. In some versions of the present invention, however, it may be desirable to fabricate jaws 12 and 14 (along with other components of clamp 10) entirely of metal, such as steel or cast aluminum; in such cases, gripping faces 16 and 18 may be formed integrally with jaws 12 and 14 respectively.

An end of jumper cable 20 is received in a bore 21 in jaw 12. Bore 21 penetrates through the plastic material of jaw 12 and into the metal insert constituting gripping face 16; consequently, when the bare wire strands of jumper cable 20 are inserted into bore 21, they come into contact with the conducting material of gripping face 16. As will be described in greater detail below, a setscrew 22 is threaded into a bore in jaw 12 which extends perpendicularly into bore 21. Setscrew 22 can thus be tightened against the end of jumper cable 20 so as to secure the end of the jumper cable in electrical contact with gripping face 16. It will be understood that the bore for receiving the jumper cable end may be provided in either of the two jaws, so long as electrical contact is established therethrough with a conducting gripping face of the clamp.

As will also be discussed in greater detail below, a handwheel 24 is provided for manual adjustment of the gap between gripping faces 16 and 18.

Figure 2:
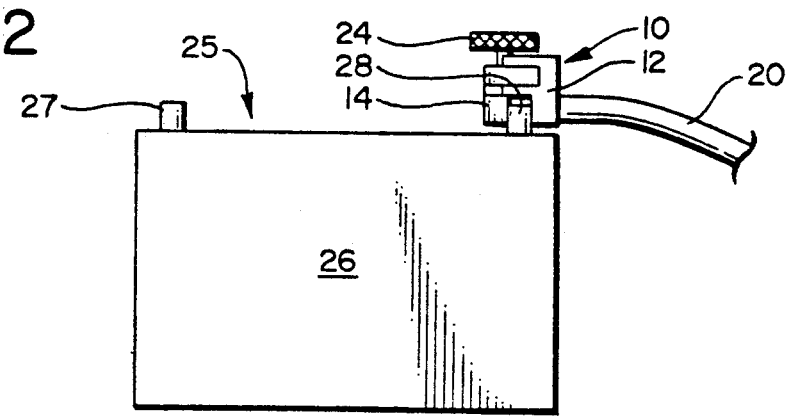
FIG. 2 is an elevational view of the clamp and jumper cable of FIG. 1 mounted to a terminal of a storage battery.

FIG. 2 shows the clamp and jumper cable of FIG. 1 mounted on a conventional vehicle storage battery 25. Storage battery 25 includes an insulating case 26, which houses the charge storage section of the battery, and from which battery posts 27 and 28 protrude upwardly. Clamp 10 is shown with battery post 28 received and clamped between its cooperating jaws.

Figure 3:
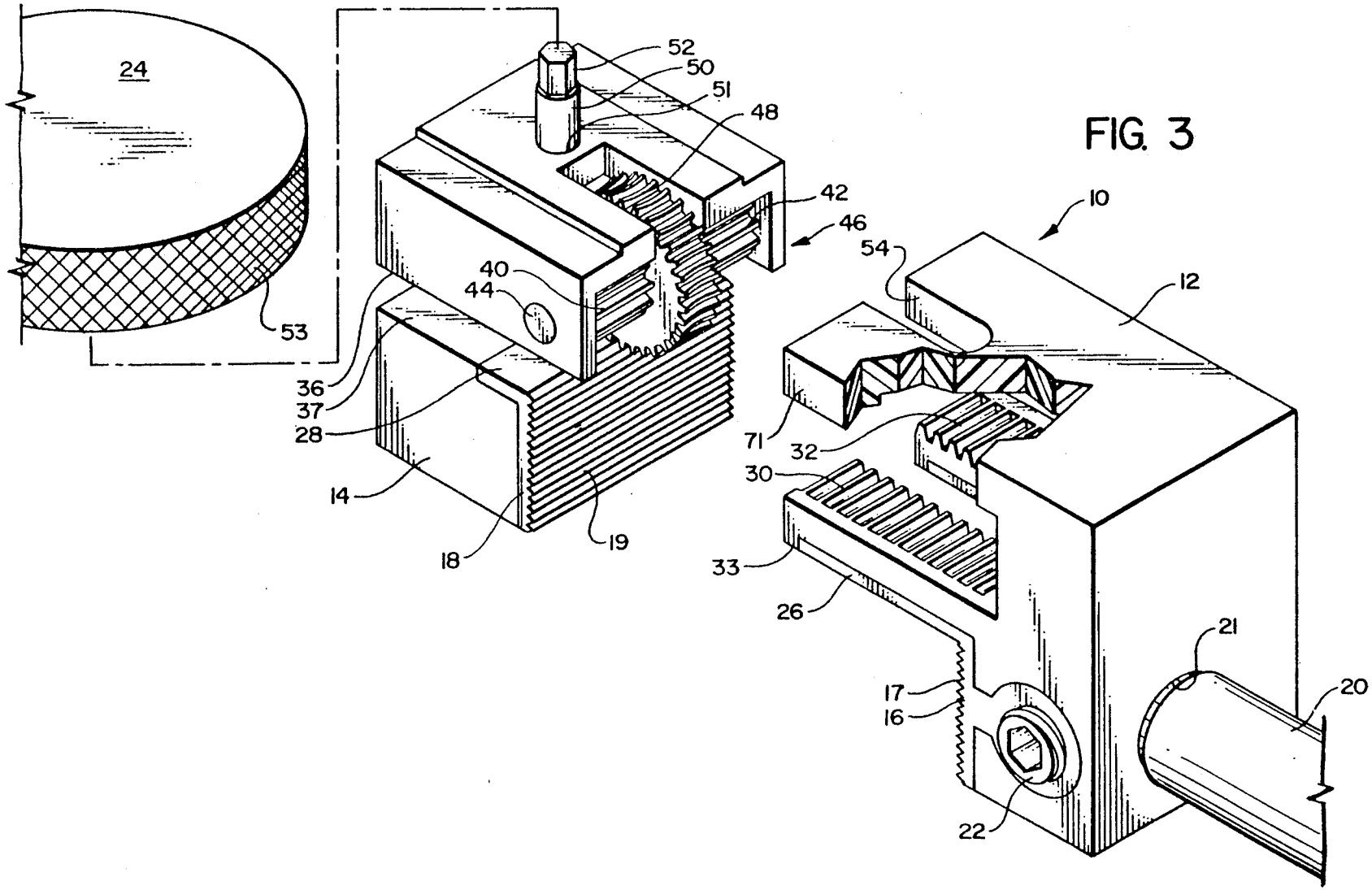
FIG. 3 is an exploded perspective view of the clamp of FIG. 1, having a cut-away portion showing the gear rack thereof.
Figure 4:
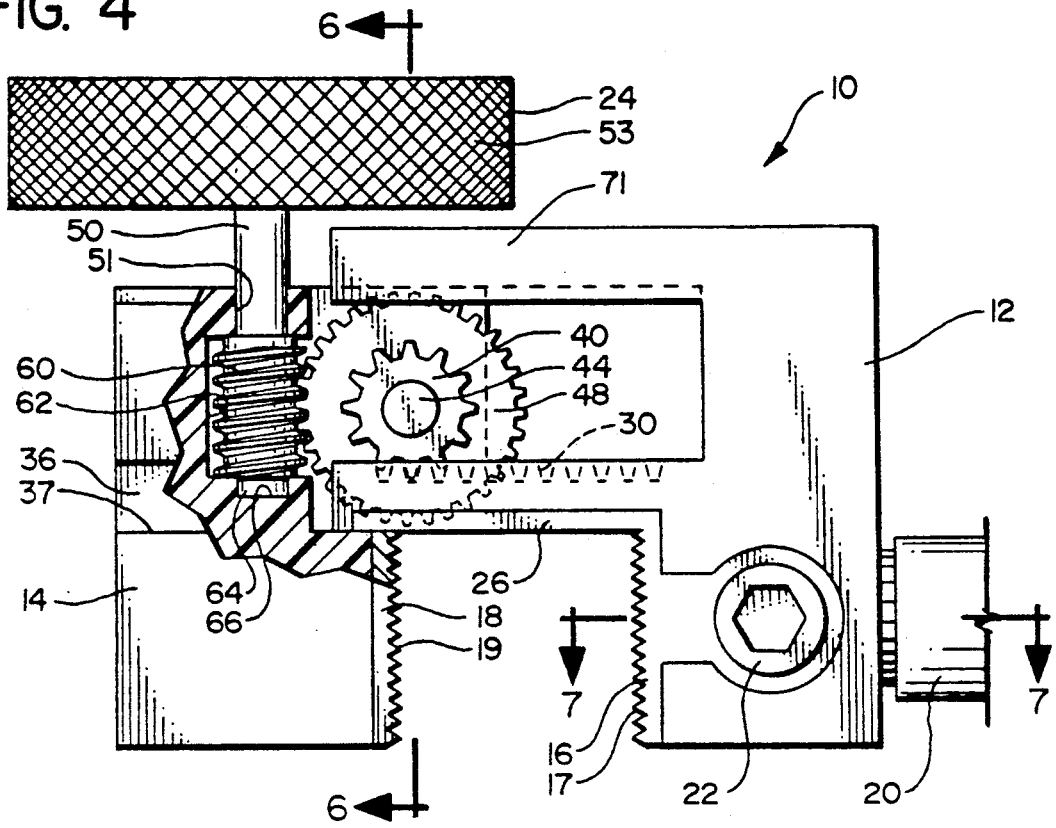
FIG. 4 is a side elevational view of the clamp of FIG. 1, having a cut-away portion showing the worm wheel engaged by the drive worm, and hidden lines showing the gear rack engaged by the pinion, the jaws of the clamp being in an extended position for receiving a battery terminal.

FIG. 3 shows the clamp 10 of FIG. 1 in an exploded or disassembled condition. Jaws 12 and 14 are shown disengaged from one another, while handwheel 24 has been removed from the top of jaw 14. It will be seen that a contact extension 26 of gripping face 16 projects substantially perpendicularly from gripping face 16, and is constructed as a continuous portion of the metallic gripping insert. When the jaws of clamp 10 are engaged with one another, as is shown in FIG. 4, extension 26 of gripping face 16 overlaps and slidingly contacts contact extension 28, which in turn extends perpendicularly to, and is continuous with, gripping face 18. Extensions 26 and 28 thus form a sliding electrical contact between gripping faces 16 and 18; this arrangement provides additional assurance that a good electrical connection will be achieved made between jumper cable 20 and the battery terminal; in the event that gripping face 16 on first jaw 12 fails to make good electrical contact with the battery terminal, but gripping face 18 on second jaw 14 does make good electrical contact, electrical current will be able to flow between jumper cable 20 and gripping face 18 through the sliding electrical contact provided by contact extensions 26 and 28. It will also be appreciated that the sliding electrical contact between extensions 26 and 28 will be maintained over a wide range of inward and outward adjustment of jaws 12 and 14.

Also extending perpendicularly from gripping face 16 on first jaw 12 are gear racks 30 and 32. Contact extension 26 is mounted flush with the lower surface 33 of gear rack 30; another contact extension may similarly be mounted to the underside of gear rack 32. When first and second jaws 12 and 14 are assembled in engagement with one another, as shown in FIG. 4, gear rack 30 slides into, and is accommodated by, a channel 36 in second jaw 14, which extends perpendicularly to gripping face 18; contact extension 28 is mounted flush with the lower surface 37 of channel 36. Similarly, second gear rack 32, which is parallel to and spaced laterally apart from first gear rack 30, is slidingly received in a second channel (not shown in FIG. 2) in second jaw 14, which second channel is similarly parallel to and laterally spaced apart from first channel 36. Thus received in second jaw 14, first gear rack 30 is engaged by pinion gear 40, so that the teeth on gear rack 30 movably mesh with the teeth on pinion gear 40. Similarly, second gear rack 32 is engaged by second pinion gear 42. Pinion gears 40 and 42 are fixed coaxially to axle 44, which in turn is rotatably mounted to second jaw 14. In the embodiment of the invention shown in FIG. 2, pinion gears 40 and 42 are mounted internally within a housing-like extension portion 46 of second jaw 14, thus providing a compact and sturdy arrangement; it will be understood, however, that the pinion gears, whether there be only one or several, may also be mounted on the exterior of jaw 14, if desired, and gear racks 30 and 32 aligned accordingly.

When gear racks 30 and 32 on first jaw 12 are slidably received within the channels of second jaw 14 so that the gear racks are engaged by pinion gears 40 and 42, rotation of pinion gears 40 and 42 will result in translational movement of racks 30 and 32, thereby moving jaw 12 relative to jaw 14 and adjusting the gap between gripping faces 16 and 18.

As noted above, pinion gears 40 and 42 are fixed to axle 44; a worn wheel gear 48 is also fixed to axle 44, coaxially with pinion gears 40 and 42. Accordingly, worm wheel gear 48 and pinion gears 40 and 42 all rotate together. As will be described in greater detail below, rotation of wheel gear 48 is achieved by means of a drive worm (not shown in FIG. 2). The drive worm has an extension shaft 50 which extends upwardly through a cooperating bore 51 in jaw 14, and which protrudes outwardly from the top thereof. Extension shaft 50 shown in FIG. 2 has a hexagonal shaft end 52, which fits into a corresponding hexagonal recess (not shown) in the underside of handwheel 24, so that handwheel 24 will not slip on shaft 50 when torque is manually applied to handwheel 24 by an operator. Of course, shaft end 52 may have any suitable configuration for preventing such slipping. Handwheel 24 is provided with knurling 53 about the circumference or outer edge thereof, so as to assist an operator in achieving a firm grip on handwheel 24 when rotating it with his hand. Handwheel 24 is also preferably relatively large in diameter, so as to provide the operator with a mechanical advantage when tightening clamp 10. A groove 54 is provided in the top of first jaw 12 to accommodate the passage therein of extension shaft 50 when such rotation of handwheel 24 results in movement of jaws 12 and 14 inwardly and outwardly relative to one another.

Having described the structure of a clamp incorporating the present invention, attention will next be directed to FIGS. 4 and 5, with reference to which the operation of the clamp shown in FIGS. 1 through 3 will be described.

With reference to FIG. 4, there is shown the clamp 10 of FIGS. 1 through 3, in an extended, open position for receiving the terminal of a storage battery. Jaws 12 and 14 are spread apart from one another so that opposing gripping faces 17 and 18 define a relatively large gap. It will be noted that, in this position, pinion gear 40 engages gear rack 30 proximate the outermost end thereof, i.e. that end of gear rack 30 which is furthest from gripping face 17 on first jaw 12.

In order to reduce the gap between gripping faces 16 and 18, pinion gear 40 is rotated (clockwise in FIG. 3) so that the teeth of pinion gear 40 sequentially engage the teeth of gear rack 30 and draw gear rack 30 to the left (in FIG. 4), thus moving first jaw 12 towards second jaw 14. The desired rotation of pinion gear 40 is achieved by manual rotation of handwheel 24, which is connected to extension shaft 50 of drive worm 60. Drive worm 60 is shown enclosed in a chamber 62 in second jaw 14. An axial stub 64 from drive worm 60 rests in a socket 66 in the lower end of chamber 62, while extension shaft 50 passes through cooperating bore 51 in jaw 14 at the upper end of chamber 62; socket 66 and bore 51 consequently serve to maintain drive worm 60 in its desired position and alignment during operation. Drive worm 60 is positioned so that the helical teeth thereon are in engagement with the radial teeth on worm wheel 48. Thus engaged, rotation of drive worm 60 about the axis of extension shaft 50 and stub 64 will result in rotation of worm wheel 48 about the axis of axle 44. Since both worm wheel 48 and pinion gear 40 are fixed to axle 44, rotation of worm wheel 48 will cause pinion gear 40 to rotate as well, in turn causing the translational movement of gear rack 30 on first jaw 12, relative to second jaw 14. For example, in the embodiment illustrated in FIG. 4, clockwise rotation of handwheel 24 by an operator will cause drive worm 60 to rotate in the same direction, which in turn will drive worm wheel 48 in a clockwise direction (as viewed in FIG. 4) about axle 44. Pinion gear 40 will thus also rotate in a clockwise direction, and will draw gear rack 30 to the left, causing the gap between gripping faces 16 and 18 to narrow. Rotation of handwheel 24 in the reverse direction will cause the gap between the gripping faces to widen.

The worm gearing provided by drive worm 60 and worm wheel gear 48 provides a large speed reduction and a resulting mechanical advantage between nonintersecting shafts 50-64 and 44, which are arranged at an angle of approximately 90° degrees to one another. This arrangement provides the clamp of the present invention with significant advantages over conventional, spring-loaded alligator clamps. For example, as noted, the arrangement affords the manual operator significant mechanical advantage when tightening the clamp against the battery terminal; the operator is easily able to tighten the clamp of the present invention much more securely against the battery terminal, so as to prevent undesirable movement, rotation, or dislodgement of the clamp, and the strength of the grip of the clamp is not limited to that of a spring (as with the alligator clamps). This increased grip can also be used to force corrugations 17 and 19 much more effectively against the battery terminal, so as to penetrate any corrosion and establish good electrical contact. Furthermore, outwardly directed force between the gripping faces, acting through the gear racks and pinions to apply torque to worm wheel 48, will generally not cause significant rotation of drive worm 60; accordingly, the operator can tighten clamp 10 about a battery terminal without fear of the clamp backing off of the terminal if the handwheel is released. In summary, the clamp of the present invention, unlike conventional alligator clamps, provides a positive, unyielding grip on battery terminals.

Figure 5:
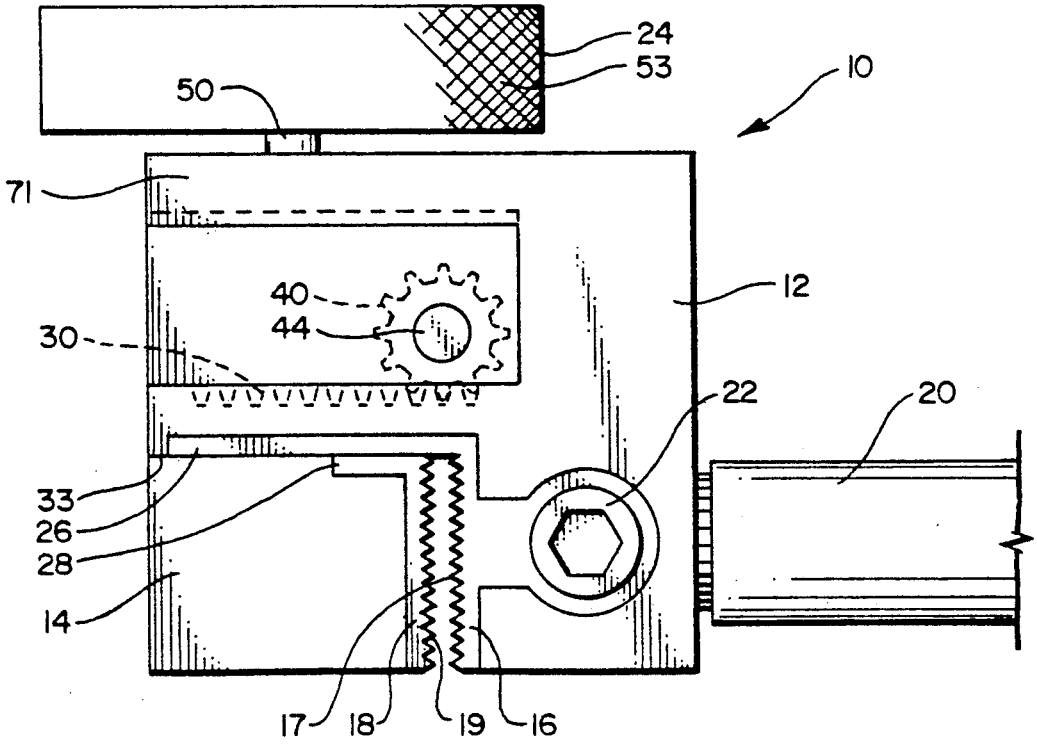
FIG. 5 is a side elevational view of the clamp shown in FIG. 4, shown in a contracted position.

FIG. 5, shows the clamp 10 of FIG. 4, with jaws 12 and 14 adjusted to achieve a narrow gap between gripping faces 16 and 18. It will be apparent that pinion gear 40 has been rotated in a clockwise direction (as seen in FIG. 5) by means of the worm drive, until it now engages gear rack 30 proximate the innermost end thereof, i.e. the end of gear rack 30 which is nearest gripping face 16. Thus adjusted, the gap between gripping faces 16 and 18 is relatively small, as may occasionally be needed for gripping small items, such as, for example, an end of a bolt projecting from a battery cable clamp, or exposed wire strands of an end of a broken battery cable.

Figure 6:
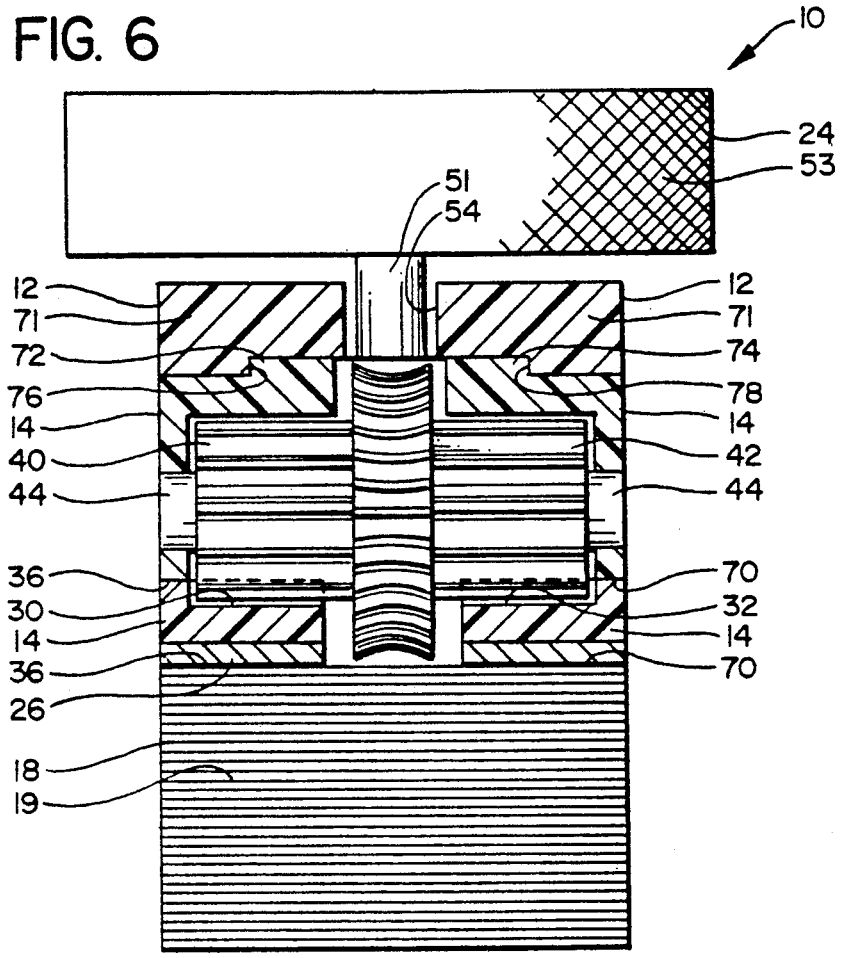
FIG. 6 is an end view of a section of the clamp shown in FIG. 4, taken along the line 5—5, showing a gripping face and the pinion gears having the worm wheel mounted thereto.

With reference now to FIG. 6, the alignment of the components of the assembled clamp 10 will be described in greater detail. FIG. 6 is an end view of a section of clamp 10, taken along line 6—6 shown in FIG. 4. Axle 44 is mounted in second jaw 14, and has pinion gears 40 and 42 and worm wheel 48 fixed coaxially thereto. Second jaw 14 also has grip face 18 on the lower end thereof. The edges of channel 36 are visible between axle 44 and grip face 18, as are the edges of corresponding channel 70 on the opposite side of jaw 14. As described above, channels 36 and 70 receive gear racks 30 and 32, which project from, and are part of, the first jaw 12. It will be seen that, when clamp 10 is fully assembled, the teeth on gear racks 30 and 32 are engaged by the teeth on pinion gears 40 and 42 respectively.

First jaw 12 also has an upper portion 71 which overlies the top of second jaw 14. The top of second jaw 14 has a pair of longitudinally extending shoulders 72 and 74 formed thereon. Longitudinally extending shoulders 72 and 74 on second jaw 14 abut against the longitudinally extending edges 76 and 74, respectively, of a channel formed in the upper portion 71 of first jaw 12 for receiving shoulders 72 and 74. Thus, the alignment of the jaws of clamp 10 is maintained by (1) the interface of gear racks 30 and 32 on jaw 12 with channels 36 and 70 on jaw 14, and (2) the interface of shoulders 72 and 74 on jaw 14 with edges 76 and 78 of the channel on jaw 12. The arrangement of two gear racks 30,32 engaged by pinion gears 40,42 near opposite sides of clamp 10 also serves to help maintain alignment of the jaws and avoid binding of the clamp mechanism by moving both sides of the jaws simultaneously and evenly, preventing the jaws from becoming cockeyed and jammed.

With additional reference to FIG. 6, it will be observed that slot 51 in the upper portion 71 of first jaw 12 provides clearance for extension shaft 50 of the drive worm as the jaws move back and forth with respect to each other.

Figure 7:
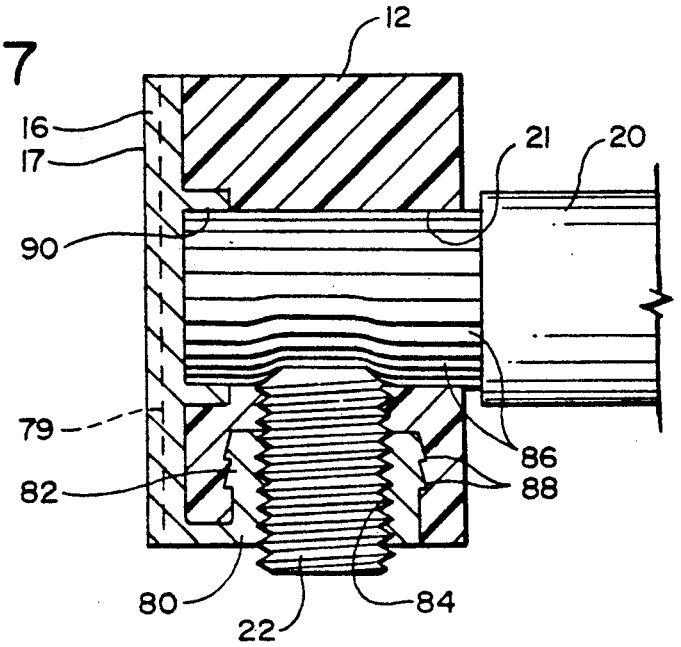
FIG. 7 is a partial plan view of a section of the clamp shown in FIG. 4, taken along line 6—6, showing the end of the jumper cable received in the clamp and secured therein by a setscrew.

With reference now to FIG. 7, there is shown a top view of a section of a lower portion of the first jaw 12 of clamp 10 shown in FIG. 4, taken along line 7—7. FIG. 7 shows grip face 16 having teeth corrugations 17, the roots of which are indicated by broken line 79. Grip face 16, which, as discussed, is an insert made of electrically conductive metal, has an ear 80 which extends around the side of jaw 12 from grip face 16. Ear 80 has a cylindrical extension 82 which is pressed into a recess in the plastic material of jaw 12. A threaded bore 84 extends through the metallic material of cylindrical extension 82 and the plastic material of jaw 12, from the exterior surface of clamp 12 into bore 21. Threaded bore 84 is perpendicular to bore 21, in which is inserted an end of jumper cable 20. Setscrew 22 is threadably engaged with threaded bore 84 so that an end thereof bears against the stripped, bare wire strands 86 of the end of jumper cable 20. The inner end of setscrew 22 compresses the wire strands 86 and secures the end of jumper cable 20 in bore 21, so as to maintain cable 20 in electrical contact with grip face 16. Cylindrical extension 82 is provided with external annular ridges 88 which react against the plastic material so as to prevent ear 80 from being driven out of the plastic material of jaw 12 by the force of setscrew 22 reacting against the wire strands 84.

In the embodiment illustrated in FIG. 7, grip face 16, ear 80 and setscrew 22 are all formed of an electrically conductive metal, so that setscrew 22 bearing against bare wire strands 86 establishes an electrical connection between grip face 16 and battery jumper cable 20. Furthermore, bore 21 extends into a recess 90 in the metal at the back of grip face 16, so that bare wire strands 86 can establish a direct electrical contact with grip face 16 when cable 20 is inserted and secured in bore 21.

The just-described connection for mounting the end of a jumper cable to a jaw of clamp 10 is advantageous in many respects, particularly from the standpoint of simplicity of use: the end of cable 20 need only be stripped of its insulation and inserted in bore 21, and setscrew 22 then tightened, in order to establish a secure and effective connection. As noted earlier, however, the wire strands of battery cables frequently fray and break due to bending and twisting of the clamps on the ends of the cables; accordingly, it is also desirable that a connection arrangement be provided which reduces or eliminates such fraying and breaking. Such a connector assembly may be manufactured and included as a part of a new, complete set of battery jumper cables and clamps, or may be provided as part of a set of replacement clamps, for attachment to the ends of old battery jumper cables from which conventional clamps have been removed.

Figure 8:
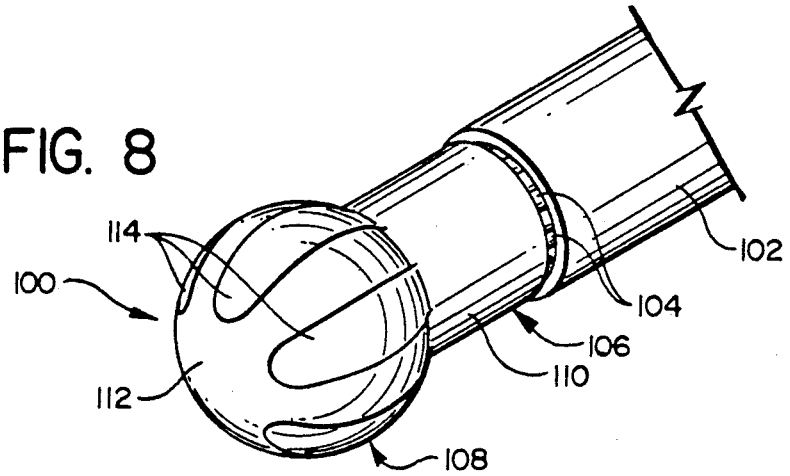
FIG. 8 is a perspective view of a male electrical connector member for connecting a cable to a clamp so that the clamp can pivot on the end of the cable.

FIG. 8 shows a male electrical connector member 100, which forms part of an electrical connection which can reduce or eliminate fraying and breaking of the wire strands of battery jumper cables in use. Male connector 100 is installed on an end of battery jumper cable 102 which has been stripped of its insulation to expose bare wire strands 104. Male connector 100 comprises generally a socket portion 106 and a spherical protuberance portion 108. Socket portion 106 includes a cylindrical metal socket 110, which receives bare wire strands 104 of jumper cable 102, and which is secured thereto by crimping, soldering, or other conventional means. Socket portion 110 may be fabricated of any conductive metal, although, for reasons which will become apparent, spring steel is a particularly suitable material.

Cylindrical protuberance section 108 includes an elastomeric ball 112, which has a spherical external surface, and about which are arranged radially splayed metal contact fingers 114, which are extensions of receptacle 110. Elastomeric ball may be formed from any suitable elastomeric material, such as rubber or injection-molded plastic. Metal contact fingers 114 are positioned about the surface of elastomeric ball 112 so that their outer surfaces are exposed at the exterior of protuberance section 108. The outer surfaces of contact fingers 114 conform generally to the cylindrical contour of the protuberance, and may be either flush with, or slightly raised above, the outer surface of elastomeric ball 112.

Spherical protuberance portion 108 may be fabricated by first forming metallic receptacle 110 with contact fingers 114, and then placing contact fingers within in a spherical mold into which the elastomeric material is subsequently injected; alternatively, elastomeric sphere 112 may be formed independently and then positioned within fingers 114.

Figure 9:
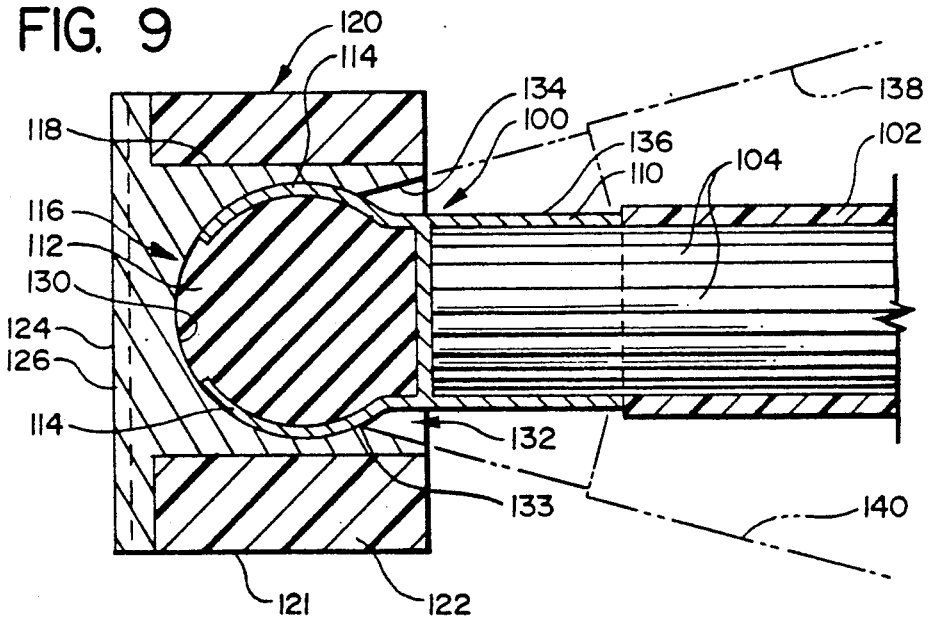
FIG. 9 is a top view of a section through a clamp mounted to a cable, showing the male connector member of FIG. 8 received in a female connector member in the clamp.

FIG. 9 shows male connector portion 100 installed in female connector member 116 in a jaw 121 of a clamp 120 in accordance with the present invention. Clamp 120, apart from the electrical connection shown in FIG. 9, is the same as that which was described above with reference to FIGS. 1 through 7. Jaw 121, accordingly, has a plastic portion 122 in which is installed a metallic insert forming a gripping face 124 having teeth or corrugations 126, which are adapted to grip a terminal of a vehicle storage battery. Female connector member 116 includes a cylindrical extension portion 118 formed of, and extending from the rear face of, metallic gripping face 124. Cylindrical extension 118 has a substantially spherical receptacle 130 formed therein for receiving spherical protuberance portion 108 of male electrical connector member 100. Spherical receptacle 130 has a mouth 132 which opens outwardly to the exterior of jaw 120. Mouth 132 has a circumferential edge 133 which defines a circular opening having a diameter greater than the external diameter of socket 110 of male connector portion 100, so as to permit movement of spherical connector portion 108 within receptacle 120, as will be described below; the opening of mouth 132, however, has a diameter significantly smaller than the external diameter of spherical protuberance portion 108, so that the latter will be retained in the receptacle. Mouth 132 also has a chamfered or beveled outer rim 134, which serves the dual purposes of assisting in the insertion of male connector portion 100 into female connector portion 116, by simultaneously guiding and compressing spherical protuberance portion 108, and permitting additional movement of spherical connector portion 108 within spherical receptacle 120, as will also be described below.

To install male connector portion 100 in female connector portion 116, spherical protuberance portion 108 is simply pressed through mouth 132 and into spherical receptacle 120; elastomeric ball 112 and contact fingers 114 are compressed as spherical protuberance section 108 passes through chamfered rim 134 of mouth 132, and then are released and expand outwardly again when they are fully positioned in spherical receptacle 130. Thus installed, contact fingers 114, which are extensions of metallic receptacle 110, bear against the metallic walls of spherical receptacle 130, establishing an effective electrical connection between jumper cable 102 and gripping face 124. The resistance of elastomeric ball 112 and fingers 114 to compression cause male connector member 100 to be retained in female connector member 116 once installed, although the two can be separated, if so desired, by exerting sufficient tension on cable 102 relative to jaw 121.

Once the male connector member has been installed in the female connector member in jaw 121, spherical protuberance portion 108 and spherical receptacle 130, in combination, form a type of ball-and-socket joint which permits rotary motion in every direction between clamp 120 and cable 102, up to the limits of the radial clearance provided between the outer wall 136 of socket 110 and edge 133 of mouth 132. Chamfered mouth rim 134 provides additional clearance for outer wall 136 of receptacle 110 as jaw 120 and cable 102 to swivel or pivot about with respect to one another, as indicated by broken line images 138 and 140. This permits clamp 120 to be swiveled, pivoted, and twisted about as necessary to position it on a battery terminal, without significantly bending the wire strands 104 and battery jumper cable 102. Even if the jaw 120 is rotated beyond the limits permitted by mouth 132, the amount that the strands of the battery cable will be required to bend will still be greatly reduced. By thus eliminating or reducing the bending of wire strands 104, the fatiguing and breaking thereof is avoided, greatly enhancing the life of the connection.

Figure 10:
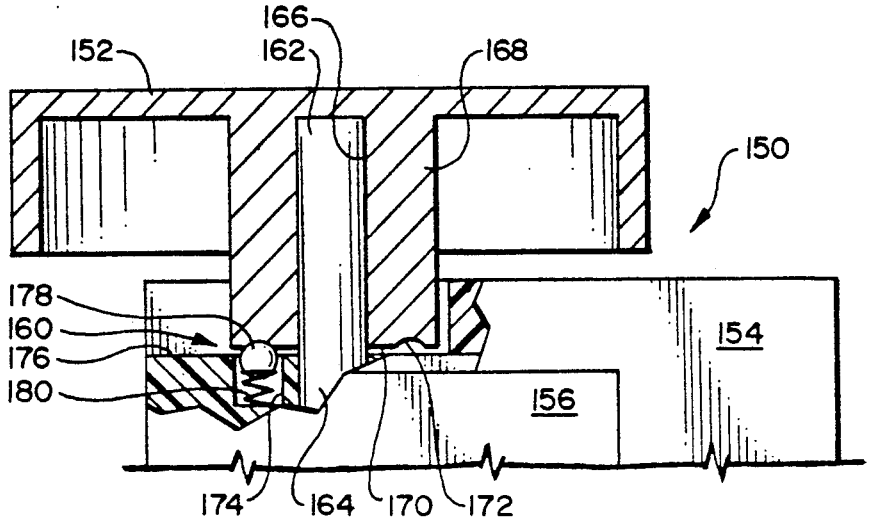
FIG. 10 is a side view of a clamp similar to that shown in FIGS. 1–7, having a cut-away portion showing a detent mechanism for yieldingly checking the rotation of the hand wheel of the clamp.

FIG. 10 shows a side view of an upper portion of a clamp 150 incorporating the present invention, having a portion thereof cut away to show a detente mechanism which renders the operation of the handwheel 152 of clamp 150 more positive. Clamp 150 includes first and second jaws 154 and 156, which, apart from the detente mechanism, are substantially identical to jaws 12 and 14 of clamp 10 described above. The detente mechanism is indicated generally by reference character 160.

As previously described, handwheel 152 is installed on an upper end 162 of an extension shaft 164 of a drive worm (not shown in FIG. 10), by inserting shaft end 162 into a central socket 166 formed in shank 168. In the version of the invention shown in FIG. 10, shank 168 is relatively large in diameter, and is provided with a lower end face 170, which extends perpendicularly about extension shaft 164. End face 170 has a series of shallow, cup-shaped recesses 172 formed therein, which are arranged radially about receptacle 166.

Detente mechanism 160 includes a cylindrical chamber 174 which opens onto upper surface 176 of jaw 156, below end face 170 of handwheel shank 168, so as to be aligned with recesses 172 as they pass thereover as handwheel 152 is rotated. A detente ball 178, which is preferably a relatively small metal ball, is positioned in cylindrical chamber 174. Recesses 172 have internal contours which substantially correspond to the exterior of detente ball 178, but which will not accommodate the major portion of ball 178. Detente ball 178 is biased upwardly by coil spring 180, which is compressed between detente ball 178 and the closed lower end of chamber 174. Lower end face 170 of shank 168 fits sufficiently close to upper surface 176 of jaw 156 to prevent detent ball 178 from escaping or becoming jammed between the surfaces. Detente ball 178 is thus retained in chamber 174 and yieldingly biased into each recess 172 in succession as they rotate by. Detente mechanism 160 thus cooperates with handwheel 152 to yieldingly check the rotation of handwheel 152 at a series of points. This resistance, while easily overcome by the torque applied by the hand of an operator, is sufficient to prevent the clamp tightening mechanism from backing off or otherwise moving slightly from the point at which the handwheel is released, rendering the action of the mechanism more positive and convenient.

As further refinements to the clamp of the present invention, each of the clamps may be color coded (e.g., red and black), and/or be marked with a "+" or "−" signs, so as to assist in the proper connection of the clamps and associated cables to the correct battery terminals. Furthermore, grip faces 16 and 18 may be suitably curved or otherwise contoured to conform to the surfaces of the battery terminals which they are intended to grip.

It is to be recognized that these and other modifications could be made to the illustrative embodiments without departing from the spirit and scope of the present invention. Accordingly, the invention is not to be limited except as by the appended claims.

What is claimed and described to be secured by Letters Patent of the United States is:

1. A portable clamp for mounting a jumper cable to a terminal of a storage battery having a contact surface of a predetermined area, said clamp comprising:

first and second relatively movable jaws, said first and second jaws having opposed gripping faces which define a gap for receiving said terminal and which are configured to establish contact with said contact surface of said terminal over a sufficient area to stabilize said portable clamp relative to said terminal against forces which are exerted on said clamp due to movement of said jumper cable which is mounted to said clamp, at least one said gripping face having an electrical conductor portion thereon for establishing electrical contact with said terminal;

means for mounting said jumper cable to said clamp so that said cable is in electrical contact with said electrical conductor portion on said gripping face;

a gear rack mounted to said first jaw;

a pinion gear rotatably mounted to said second jaw, so that said pinion gear engages said gear rack on said first jaw; and means operable for rotating said pinion gear in engagement with said gear rack so that said gap is adjusted by the resulting movement of said second jaw relative to said first jaw;

whereby said portable clamp having said jumper cable mounted thereto is manually positionable adjacent said storage battery with said terminal received in said gap between said jaws, and said gap is adjustable to grip said terminal between said jaws so that said contact of said gripping faces with said contact surface of said terminal stabilizes said clamp on said terminal against said forces exerted on said clamp due to movement of said jumper cable.

2. The clamp of claim 1, wherein each said jaw is made of reinforced plastic, and said electrical conductor portion is a metal insert on a said gripping face of said jaw.

3. The clamp of claim 1, wherein said means operable for rotating said pinion comprises:

a worm wheel coaxially mounted to said pinion gear;

a drive worm in engagement with said worm wheel; and a handwheel mounted to said drive worm for manual rotation of said drive worm.

4. The clamp of claim 1, wherein said means for mounting said jumper cable to said clamp so that said cable is in electrical contact with said electrical conductor portion of a said jaw comprises:

a first bore in said jaw for receiving an end of said jumper cable, said first bore penetrating into said electrical conductor portion;

a threaded second bore in said jaw, said second bore penetrating said first bore at an angle thereto; and a setscrew in threadable engagement with said threaded second bore for bearing against said end of said jumper cable when said end is received in said first bore.

5. The clamp of claim 1, wherein said means for mounting said jumper cable to said clamp so that said cable is in electrical contact with said electrical conductor portion of a said jaw comprises:

a male connector member attachable to an end of said jumper cable, said male connector member having a substantially cylindrical conductive metal socket portion for receiving said end of said cable, and a protuberance portion having a substantially spherical exterior, said spherical protuberance portion comprising;

an elastomeric ball having a substantially spherical outer surface; and a plurality of contact fingers extending from said metal socket portion and disposed radially about said spherical outer surface of said elastomeric ball; and a female connector member mounted to said jaw, said female connector member having a receptacle portion electrically connected to said electrical conductor portion of said jaw, said receptacle portion comprising:

a conductive metal receptacle having a substantially spherical recess for receiving said spherical protuberance portion of said male connector member so that said contact fingers are in electrical contact with said metal receptacle, said receptacle further having a substantially circular mouth for passage therethrough of said spherical protuberance portion, said circular mouth having an inside diameter less than the external diameter of said spherical protuberance portion and the internal diameter of said spherical recess, but greater than the external diameter of said cylindrical socket portion, so that said spherical protuberance portion is compressed by said passage through said mouth of said receptacle and is released within said spherical recess of said receptacle;

whereby said spherical protuberance portion is retained in said receptacle portion, and said clamp is free to rotate about said protuberance portion in said receptacle portion while avoiding bending of said cable.

6. The clamp of claim 1, wherein said first and second jaws are cast metal.

7. The clamp of claim 1, wherein each said gripping face has a corrugated surface.

8. A jumper cable for attachment to a terminal of a storage battery, said jumper cable comprising:

at least one electrical cable; and a portable clamp attached to an end of said electrical cable, said clamp having first and second relatively movable jaws, said first and second jaws having opposed gripping faces which define a gap for receiving said terminal and which are configured to establish contact with said contact surface of said terminal over a sufficient area to stabilize said portable clamp relative to said terminal against forces which are exerted on said clamp due to movement of a said jumper cable which is mounted to said clamp, at least one said gripping face having an electrical conductor portion thereon for establishing electrical contact with said terminal;

means for mounting said jumper cable to said clamp so that said cable is in electrical contact with said electrical conductor portion on said gripping face;

a gear rack mounted to said first jaw;

a pinion gear rotatably mounted to said second jaw, so that said pinion gear engages said gear rack on said first jaw; and means operable for rotating said pinion gear in engagement with said gear rack so that said gap is adjusted by the resulting movement of said second jaw relative to said first jaw;

whereby said portable clamp having said jumper cable mounted thereto is manually positionable adjacent said storage battery with said terminal received in said gap between said jaws, and said gap is adjustable to grip said terminal between said jaws so that said contact of said gripping faces with said contact surface of said terminal stabilizes said clamp on said terminal against said forces exerted on said clamp due to movement of said jumper cable.

9. An electrical connector for connecting an electrical cable to a fixture having an electrical conductor portion, said connector comprising:

a male connector member attachable to an end of said electrical cable, said male connector member having a substantially cylindrical conductive metal socket portion for receiving said end of said cable, and a protuberance portion having a substantially spherical exterior, said spherical protuberance portion comprising;

an elastomeric ball having a substantially spherical outer surface; and a plurality of contact fingers extending radially from said metal socket portion and disposed about said spherical outer surface of said elastomeric ball; and a female connector member mounted to said fixture, said female connector member having a receptacle portion electrically connected to said electrical conductor portion of said fixture, said receptacle portion comprising:

a conductive metal receptacle having a substantially spherical recess for receiving said spherical protuberance portion of said male connector member so that said contact fingers are in electrical contact with said metal receptacle, said receptacle further having a substantially circular mouth for passage therethrough of said spherical protuberance portion, said circular mouth having an inside diameter less than the external diameter of said spherical protuberance portion and the internal diameter of said spherical recess, but greater than the external diameter of said cylindrical socket portion, so that said spherical protuberance portion is compressed by said passage through said mouth of said receptacle and is released within said spherical recess of said receptacle;

whereby said spherical protuberance portion is retained in said receptacle portion, and said fixture is free to rotate about said protuberance portion in said receptacle portion while avoiding bending of said cable.

10. A clamp for mounting a jumper cable to a terminal of a storage battery, said clamp comprising:

first and second relatively movable jaws made of reinforced plastic, said first and second jaws having opposed gripping faces which define a gap for receiving said terminal, at least one said gripping face having a metal insert for establishing electrical contact with said terminal;

means for mounting said jumper cable to said clamp so that said cable is in electrical contact with said metal insert on said gripping face;

a gear rack mounted to said first jaw;

a pinion gear rotatably mounted to said second jaw, so that said pinion gear engages said gear rack on said first jaw; and means operable for rotating said pinion gear in engagement with said gear rack so that said gap is adjusted by the resulting movement of said second jaw relative to said first jaw.

11. A clamp for mounting a jumper cable to a terminal of a storage battery, said clamp comprising:

first and second relatively movable jaws, said first and second jaws having opposed gripping faces which define a gap for receiving said terminal, at least one said gripping face having an electrical conductor portion thereon for establishing electrical contact with said terminal;

a male connector member attachable to an end of said jumper cable, said male connector member having a substantially cylindrical conductive metal socket portion for receiving said end of said cable, and a protuberance portion having a substantially spherical exterior, said spherical protuberance portion comprising:

an elastomeric ball having a substantially spherical outer surface; and a plurality of contact fingers extending from said metal socket portion and disposed radially about said spherical outer surface of said elastomeric ball; and a female connector member mounted to said jaw, said female connector member having a receptacle portion electrically connected to said electrical conductor portion of said jaw, said receptacle portion comprising:

a conductive metal receptacle having a substantially spherical recess for receiving said spherical protuberance portion of said male connector member so that said contact fingers are in electrical contact with said metal receptacle, said receptacle further having a substantially circular mouth for passage therethrough of said spherical protuberance portion, said circular mouth having an inside diameter less than the external diameter of said spherical protuberance portion and the internal diameter of said spherical recess, but greater than the external diameter of said cylindrical socket portion, so that said spherical protuberance portion is compressed by said passage through said mouth of said receptacle and is released within said spherical recess of said receptacle so that said spherical protuberance portion is retained in said receptacle portion and said clamp is free to rotate about said protuberance portion in said receptacle portion while avoiding bending of said cable;

a gear rack mounted to said first jaw;

a pinion gear rotatably mounted to said second jaw, so that said pinion gear engages said gear rack on said first jaw; and means operable for rotating said pinion gear in engagement with said gear rack so that said gap is adjusted by the resulting movement of said second jaw relative to said first jaw.

* * * * *